US007083396B2

(12) United States Patent
Kawano et al.

(10) Patent No.: US 7,083,396 B2
(45) Date of Patent: Aug. 1, 2006

(54) BALANCED VARIABLE DISPLACEMENT FLUID APPARATUS

(75) Inventors: Shigeru Kawano, Kariya (JP); Hirokazu Kamiya, Takahama (JP); Masafumi Inoue, Tajimi (JP); Shigeru Kamiya, Nukata-gun (JP); Mikio Matsuda, Okazaki (JP); Takashi Inoue, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 345 days.

(21) Appl. No.: 10/438,909

(22) Filed: May 16, 2003

(65) Prior Publication Data

US 2003/0223887 A1 Dec. 4, 2003

(30) Foreign Application Priority Data

May 29, 2002 (JP) ..... 2002-155162
Mar. 25, 2003 (JP) ..... 2003-082576

(51) Int. Cl.
*F04B 1/12* (2006.01)

(52) U.S. Cl. ..... 417/269; 92/71

(58) Field of Classification Search ..... 417/269; 91/499; 92/71

See application file for complete search history.

(56) References Cited

U.S. PATENT DOCUMENTS 4,235,116 A * 11/1980 Meijer et al. ..... 74/60
4,836,090 A * 6/1989 Smith ..... 92/12.2
5,063,829 A * 11/1991 Takao et al. ..... 92/71
5,105,728 A * 4/1992 Hayase et al. ..... 92/71
5,937,731 A * 8/1999 Kazahaya ..... 92/12.2

FOREIGN PATENT DOCUMENTS

JP A-S63-94085 4/1988
JP 01-138376 * 5/1989
JP A-H02-275070 11/1990

* cited by examiner

*Primary Examiner*—Charles G. Freay
(74) *Attorney, Agent, or Firm*—Posz Law Group, PLC

(57) ABSTRACT

In a fluid apparatus used as a compressor, a swing support member is constructed of a hook-type adjustable joint, and supports a swing member in capable of swinging while restricting the swing member from rotating about a center axis of a shaft of the compressor. A variable mechanism portion is constructed of a rotary member rotatable around the shaft, the swing member and the like. A slant center around which the swing member swings is made to substantially correspond to a center of gravity of the variable mechanism portion. Therefore, a slant moment, for changing a slant angle of the swing member, is not structurally generated. Accordingly, even when the compressor operates, large vibration and large noise can be prevented, thereby improving durability of the compressor.

4 Claims, 15 Drawing Sheets

BALANCED VARIABLE DISPLACEMENT FLUID APPARATUS

CROSS-REFERENCE TO RELATED APPLICATION

This application is related to and claims priority from Japanese Patent Applications No. 2002-155162 filed on May 29, 2002, and No. 2003-82576 filed on Mar. 25, 2003, the contents of which are hereby incorporated by reference.

BACKGROUND OF THE INVENTION

1. Field of the Invention

The present invention relates to a fluid apparatus such as a wobble-type fluid apparatus and a swash-plate fluid apparatus, which is suitably used for a compressor in a vapor compression refrigerant cycle for a vehicle.

2. Description of Related Art

A wobble-type fluid apparatus (e.g., swing-swash plate compressor) includes a rotary member, a swing member and a rotation lock mechanism. The rotary member has a swash surface slanted relative to a shaft of the fluid apparatus, and rotates integrally with the shaft. The swing member is connected to the swash surface through a thrust bearing, and swings with the rotation of the rotary member, thereby reciprocating a piston of the fluid apparatus. The rotation lock mechanism is disposed to prevent the swing member from rotating together with the rotary member.

JP-A-63-94085 proposes a swing support mechanism used as the rotation lock mechanism. Specifically, in JP-A-63-94085, a bevel gear provided on the rotary member is engaged with a bevel gear provided on the swing member, thereby constructing the swing support mechanism. The swing support member supports the swing member in capable of swing. Therefore, when the fluid apparatus such as the compressor is operated, noise is readily generated due to gear collision between the bevel gears.

On the other hand, in JP-A-2-275070, the swing member is supported by a spherical slide surface of a slide member, thereby reducing the noise due to the gear collision. However, when the shaft rotates at a high rotational speed, the swing member swings and vibrates while rotating about the shaft. The vibration from the swing member is transmitted to a housing of the compressor, thereby causing large sound noise. Furthermore, at this time, the slide member and its support portion slide at a high rotational speed, thereby reducing reliability (durability) of the compressor.

Further, since the swing member has an unsymmetrical shape due to the rotation lock portion disposed on the swing member, a moment is structurally applied to the swing member so as to increase or decrease its slant angle with respect to the shaft. As a result, in a variable displacement compressor for controlling its displacement by changing the slant angle of the swing member, the displacement (i.e., slant angle) becomes unstable, thereby inducing oscillation due to hunting.

SUMMARY OF THE INVENTION

It is an object of the present invention to improve durability of a fluid apparatus and to reduce its sound noise, even when the fluid apparatus operates at a high rotational speed.

According to a first aspect of the present invention, a fluid apparatus includes a shaft disposed to be rotatable, a plurality of pistons disposed to be reciprocated, a housing for containing the shaft and having a plurality of cylinder bores in which the pistons are disposed, a rotary member rotatable integrally with the shaft, a swing member connected to a slant surface of the rotary member through a thrust bearing, and a swing support mechanism for supporting the swing member in capable of swinging. Further, the slant surface of the rotary member is disposed to slant with respect to a center axis of the shaft, and the swing member swings in accordance with rotation of the rotary member, for reciprocating the pistons. The swing support mechanism has a first rotation member rotatable about a first axial line that is perpendicular to the center axis of the shaft, a lock member connected to the first rotation member in order to restrict the first rotation member from rotating about the center axis of the shaft, and a second rotation member connected to the first rotation member to be rotatable about a second axis that is perpendicular to the center axis and crosses with the first axis. In the swing support mechanism, the second rotation member is connected to the swing member. In the fluid apparatus, the rotary member, the thrust bearing, the swing member and the second rotation member are disposed to construct a variable mechanism portion. Further, the swing support mechanism has a slant center around which the swing member swings, and the slant center is positioned substantially at a center of gravity of the variable mechanism portion. Accordingly, a slant moment for changing a slant angle of the swing member relative to the shaft is not structurally generated. Furthermore, a deviated dimension of the slant center from the center of the gravity of the variable mechanism portion is substantially zero. Therefore, It can prevent large vibration and large noise from being caused even when the shaft of the fluid apparatus operates at a high rotational speed. For example, the slant center is a crossing point between the first axis and the second axis.

Preferably, a plurality of connection rods for connecting the swing member and the pistons are disposed, and the slant center is positioned opposite the pistons with respect to a connection line passing through connection centers between the swing member and the connection rods. Therefore, the slant center can readily correspond to the center of the gravity of the variable mechanism.

According to a second aspect of the present invention, a fluid apparatus includes a shaft disposed to be rotatable, a plurality of pistons disposed to be reciprocated, a housing having a plurality of cylinder bores in which the pistons are disposed, a swash plate rotatable integrally with the shaft for reciprocating the pistons, and a shoe disposed at a radial outside portion of the swash plate to pinch the swash plate while slidably contacting the swash plate. In the fluid apparatus, the swash plate is disposed to slant with respect to a center axis of the shaft, and the swash plate and the pistons are connected through the shoe to be reciprocated. Further, the swash plate has a slant center about which the swash plate rotates while slanting, and the slant center substantially corresponds to a gravity center of the swash plate. Accordingly, even in this structure, a slant moment for changing the slant angle of the swash plate is not structurally caused. Therefore, the durability of the fluid apparatus can be improved while noise generated in the fluid apparatus can be effectively restricted.

Preferably, a balancer is provided for adjusting the slant center of the swash plate at a position substantially corresponding to the gravity center of the swash plate, regardless of a slant angle of the swash plate with respect to the center axis of the shaft. Therefore, the slant center can readily correspond to the gravity center of the swash plate. Generally, the gravity center of the swash plate is substantially on the center axis of the shaft.

When the swash plate includes a circular plate having a slide surface slidably contacting the shoe, and an arm for transmitting rotation of the shaft to the circular plate, the arm is integrated to the circular plate at a position offset from a center of gravity in the circular plate, and the balancer is provided in the circular plate at a position except for the slide surface. The balancer can be provided in the circular plate on the same side as the arm with respect to a center line of the circular plate. Alternatively, the balancer can be provided in the circular plate at a side opposite the arm with respect to the center line of the circular plate. Further, the balancer can be provided on the circular plate at an outer periphery.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the appended drawings.

FIRST EMBODIMENT

Figure 1:
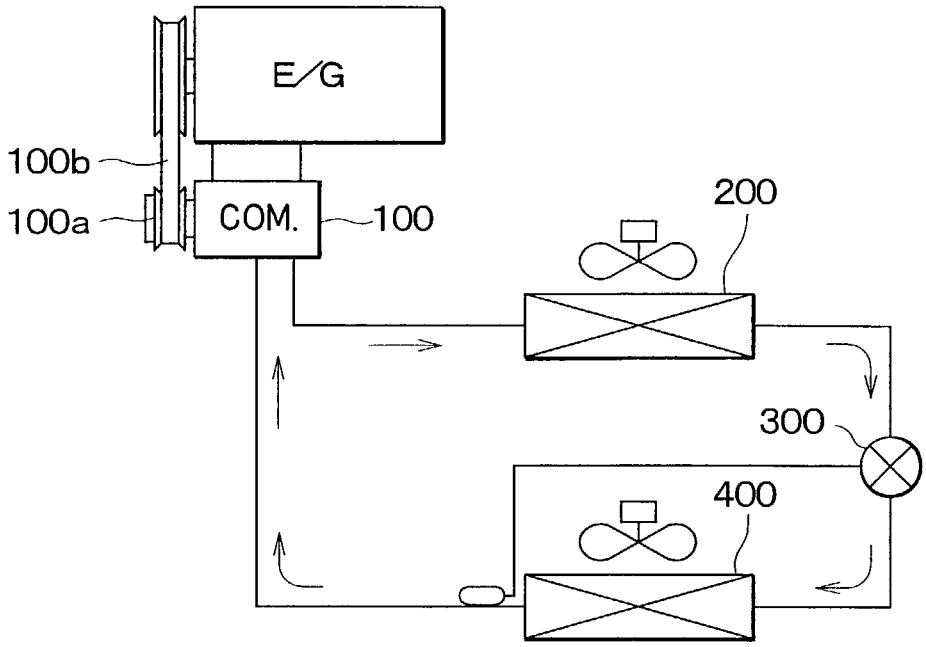
FIG. 1 is a schematic diagram showing a vapor compression refrigerant cycle with a compressor (fluid apparatus) according to preferred embodiments of the present invention.

In the first embodiment, a fluid apparatus of the present invention is typically used for a wobble-type variable displacement compressor in a vapor compression refrigerant cycle for a vehicle shown in FIG. 1. The vapor compression refrigerant cycle with the compressor can he suitably used for a vehicle air conditioner. In FIG. 1, a compressor 100 sucks and compresses refrigerant by using motive power from an engine E/G that is a drive source for driving the vehicle. A part of the motive power from the engine E/G is transferred to the compressor 100 through a pulley 100*a* and a V-belt 100*b*.

A condenser 200 is a radiator for condensing (cooling) refrigerant discharged from the compressor 100 by performing heat exchange between the discharged refrigerant from the compressor 100 and outside air. A decompression device 300 decompresses refrigerant flowing from the condenser 200. An evaporator 400 is a low-pressure heat exchanger for cooling air to be blown into a passenger compartment by performing heat exchange between refrigerant decompressed by the decompression device 300 and the air. That is, the decompressed refrigerant from the decompression device 300 is evaporated in the evaporator 400 by absorbing heat from air, so that air passing through the evaporator 400 is cooled. In the first embodiment, a thermal expansion valve is adopted as the decompression device 300. In this case, an open degree of the decompression device 300 is adjusted so that a heating degree of refrigerant to be sucked into the compressor 100 is controlled to a predetermined degree.

Figure 2:
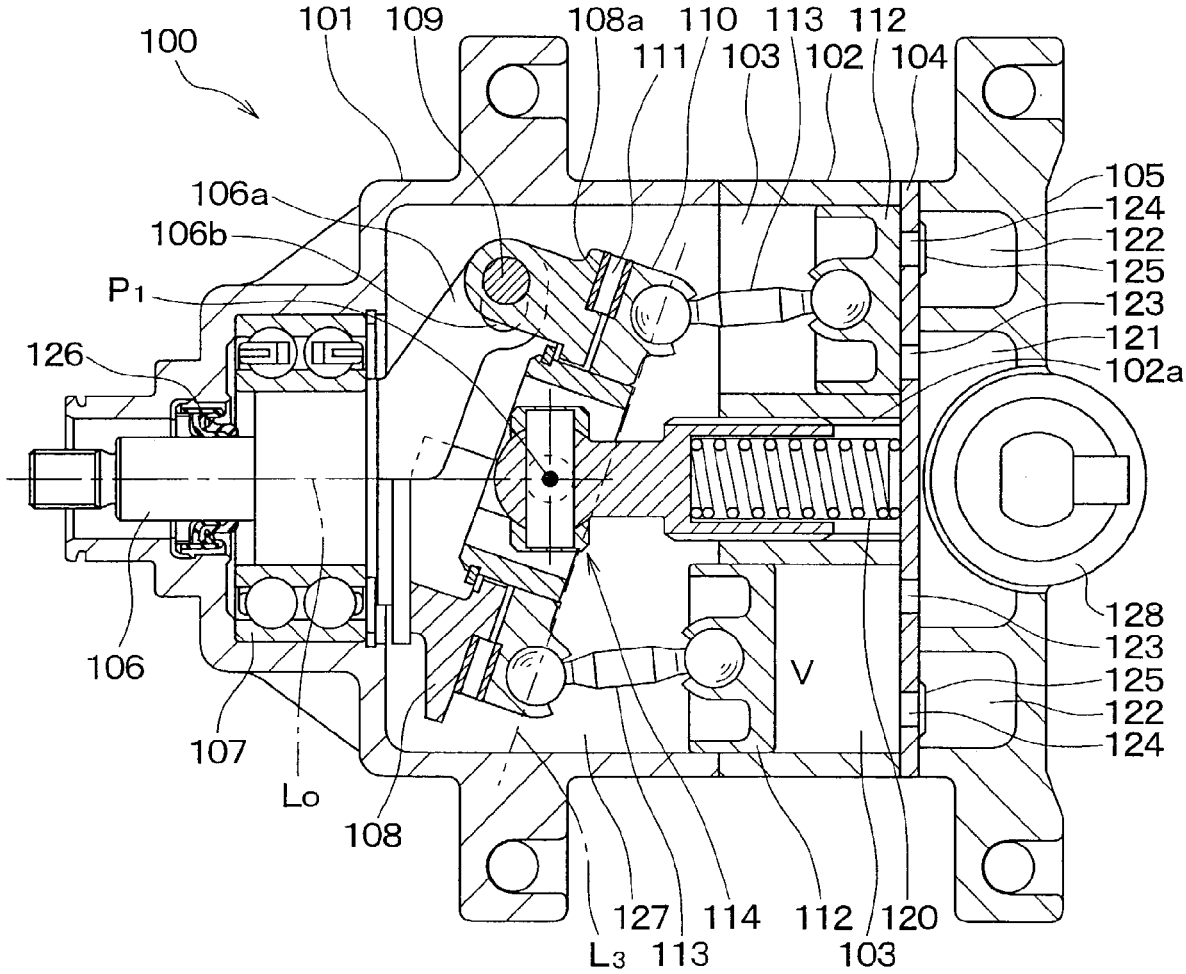
FIG. 2 is a cross-sectional view showing a compressor in a maximum-displacement operation (100% displacement operation), according to a first embodiment of the present invention.

Next, the structure of the compressor 100 will be described. In FIG. 2, a front housing 101 is made of aluminum, and a middle housing 102 has plural (e.g., five in the first embodiment) cylinder bores (cylindrical spaces) 103. A valve plate 104 has a circular shape, and closes the cylinder bores 103 at one end side. The valve plate 104 is sandwiched between the middle housing 102 and a rear housing 105, and is fixed thereto. In the first embodiment, a housing member of the compressor 100 is constructed of the front housing 101, the middle housing 102 and the rear housing 105.

A shaft 106 is rotated by motive power from a vehicle engine (not shown), and is rotatably supported in the housing member through a radial bearing 107. A rotary member 108 is connected to a top end of an arm 106*a* integrated to the shaft 106, and rotates integrally with the shaft 106. Further, the rotary member 108 has a slant surface 108*a* slanting with respect to the shaft 106. A connection pin 109 has a cylindrical shape, and constructs a hinge mechanism for rotatably connecting the rotary member 108 to the arm 106*a*. An elliptical hole 106*b* is provided in the arm 106*a*, and the connection pin 109 is inserted into the hole 106*b* from the rotary member 108. Therefore, as described later, when a slant angle θ of the rotary member 108 is changed, the connection pin 109 moves while sliding in the hole 106*b* in its longitudinal direction. Here, the slant angle θ is an angle between the slant surface 108*a* and a center axis Lo of the shaft 106.

A swing member 110 has an annular shape, and is connected to the slant surface 108*a* of the rotary member 108 through a thrust bearing 111. The swing member 110 swings at its outer peripheral side while the rotary member 108 rotates. The rotary member 108 is disposed to be rotatable through the thrust bearing 111 relative to the swing member 110 around an axis that is perpendicular to the slant surface 108*a*. In the first embodiment, a roll bearing, including substantially cylindrical rollers, is used as to thrust bearing 111.

Pistons 112 reciprocate in the cylinder bores 103, and the pistons 112 are connected to the swing member 110 by rods 113. At this time, one end of each rod 113 is movably connected to an outer periphery portion of the swing member 110, and the other end thereof is movably connected to the pistons 112. Therefore, when the shaft 106 rotates so that the swing member 110 swings, the pistons 112 reciprocate in the cylinder bores 103, respectively.

A swing support mechanism 114 is located substantially at a center area of the swing member 110, and supports the swing member 110 in capable of swinging. Furthermore, the swing support mechanism 114 prevents the swing member 110 from rotating together with the rotary member 108. Next, the swing support mechanism 114 will be described in detail with reference to FIGS. 3–5.

Figure 4:
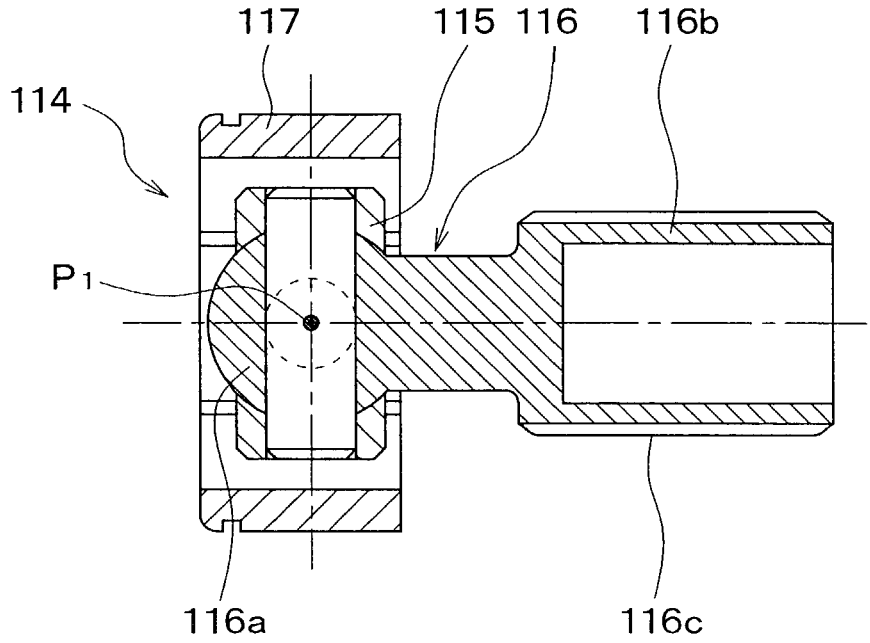
FIG. 4 is a cross-sectional view taken along line IV—IV in FIG. 3.
Figure 5:
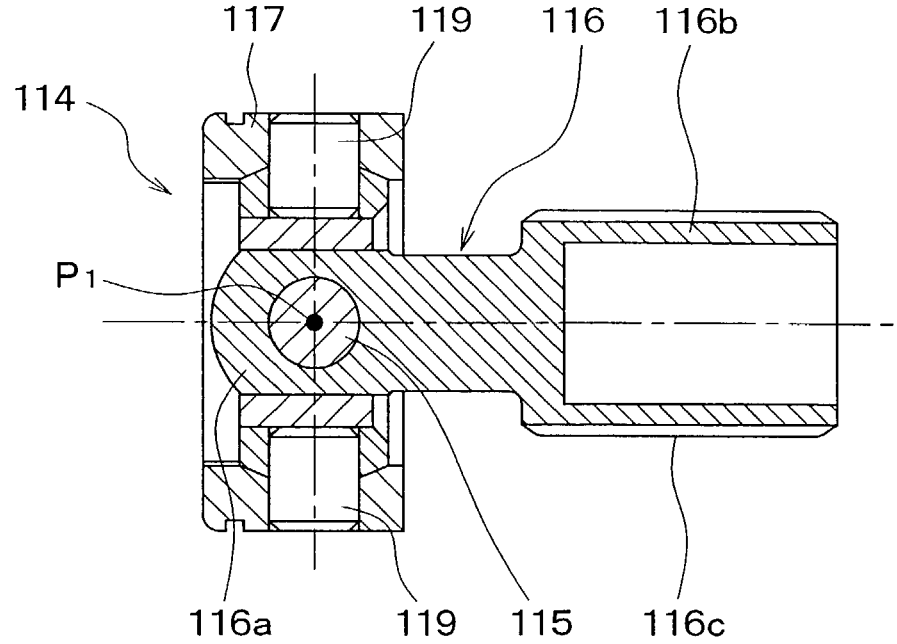
FIG. 5 is a cross-sectional view taken along line V—V in FIG. 3.
Figure 6A:
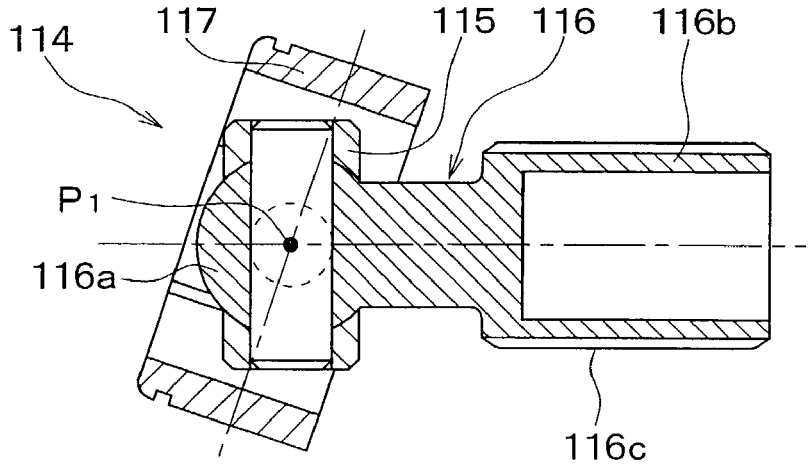
FIGS. 6A–6C are cross-sectional views corresponding to the cross-sectional view of FIG. 4, each showing an operation state of the swing support mechanism.
Figure 6B:
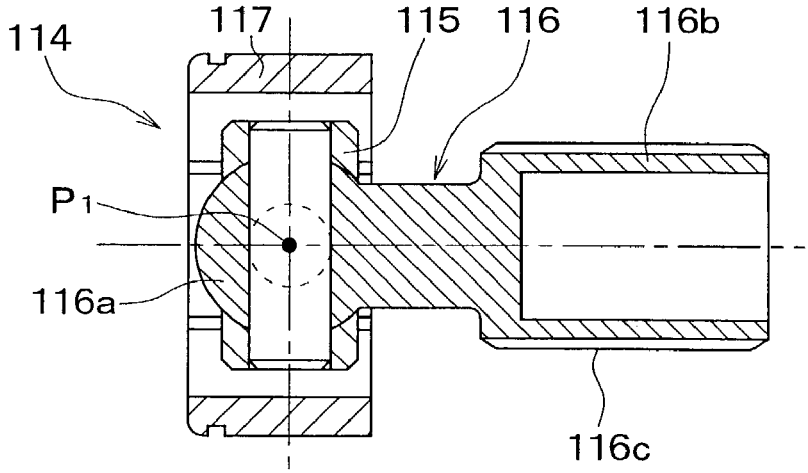
Figure 6C:
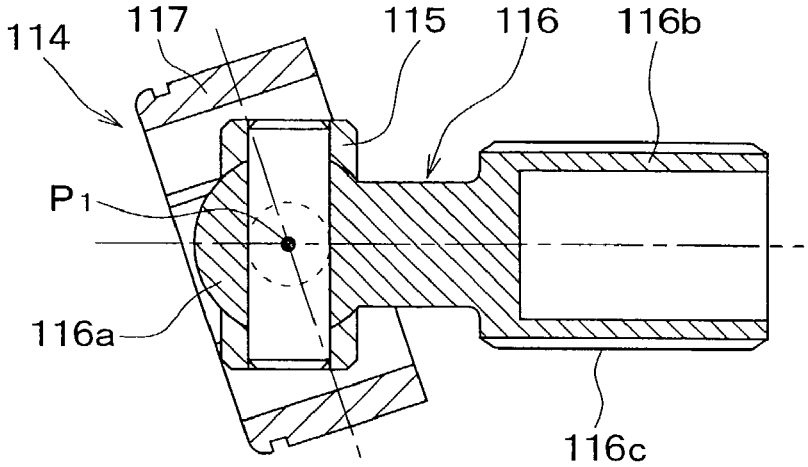
Figure 7A:
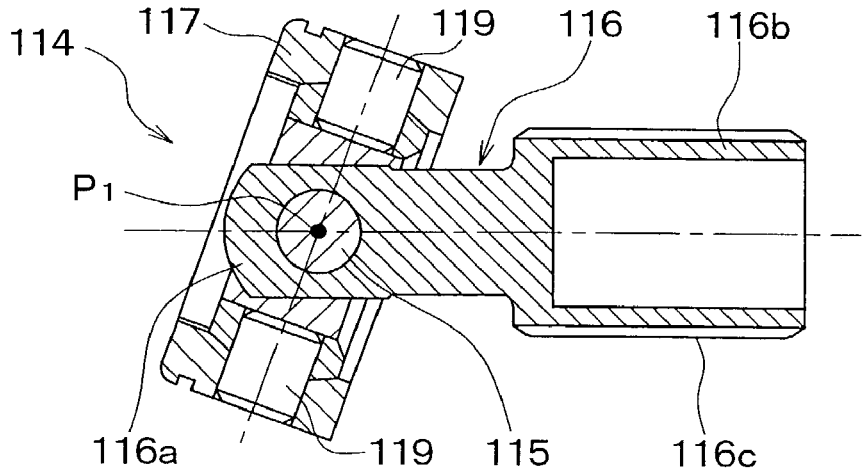
FIGS. 7A–7C are cross-sectional views corresponding to the cross-sectional view of FIG. 5, each showing an operation state of the swing support mechanism.
Figure 7B:
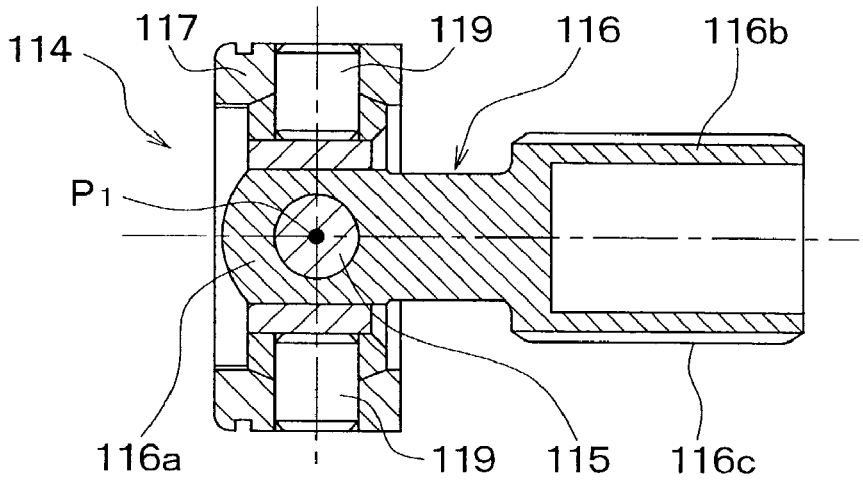
Figure 7C:
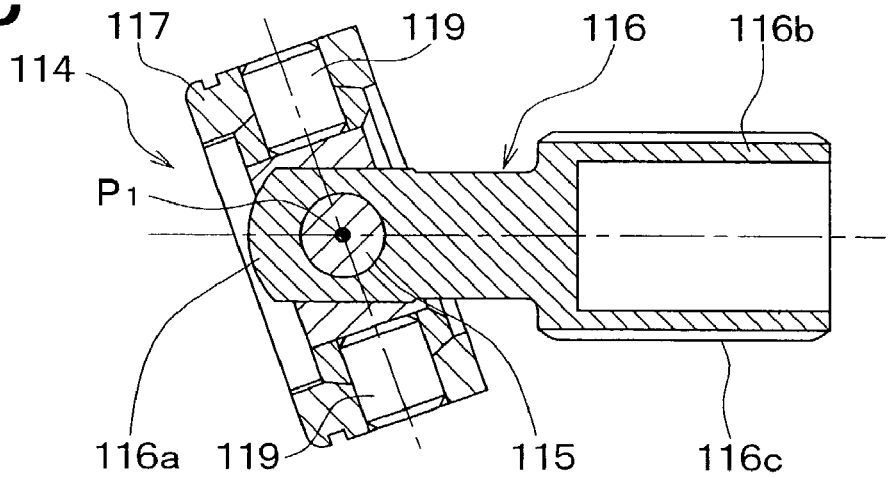

A first rotation member 115 has a substantially annular shape, and is capable of rotating about a first axis L1 that is perpendicular to the center axis Lo of the shaft 106. A lock member 116 is connected to the first rotation member 115, and restricts the first rotation member 115 from rotating about the center axis Lo. As shown in FIG. 4, the lock member 116 includes a slide portion 116*a* located on an inner peripheral surface of the first rotation member 115, and a support portion 116*b* having a substantially cylindrical shape. The support portion 116*b* has plural splines (refer to Japanese Industrial Standard JIS B 1601) on its outer peripheral surface, and its cross-section has a gear shape. As shown in FIG. 2, the middle housing 102 has a hole 102*a* substantially at its center. A cross sectional shape of the hole 102*a* is similar to that of the support portion 116*b* of the lock member 116. The support portion 116*b* of the lock member 116 is slidably inserted into the bole 102*a*, so that to lock member 116 is engaged with the middle housing 102 to be slidable in the center axial direction Lo. However, the lock member 116 is incapable of rotating relative to the middle housing 102.

Figure 3:
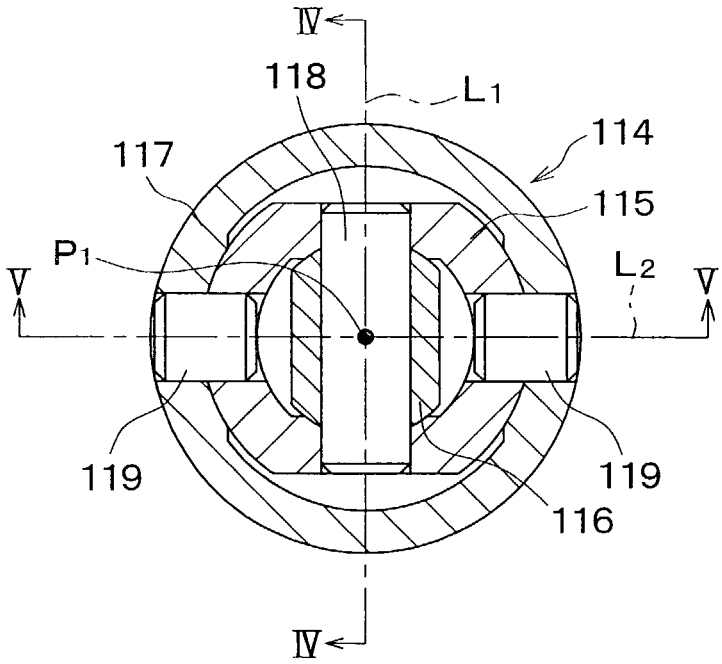
FIG. 3 is a cross-sectional view showing a swing support mechanism of the compressor according to the first embodiment.

In FIG. 3, a second rotation member 117 is located radial outside of the first rotation member 115, and has a substantially annular shape. The second rotation member 117 is connected to the first rotation member 115 in capable of rotating about a second axis L2. Here, the second axis L2 is perpendicular to the center axis Lo, and crosses with the first axis L1. The second rotation member 117 is press-fitted to the swing member 110. The first rotation member 115 is connected to the lock member 116 by a first pin member 118 having a cylindrical shape. The second rotation member 117 is connected to the first rotation member 115 by two second pin members 119 each having a cylindrical shape. Further, as shown in FIG. 2, a coil spring 120 is disposed in the support portion 116*b* of the lock member 116, so as to press the swing member 114 toward the shaft 106.

In the first embodiment, as shown in FIG. 3, the shape and dimensions of a variable mechanism portion are set, so that a slant center P1 that is a crossing point between the first and second axes L1, L2 substantially corresponds to a center of gravity of the variable mechanism portion. The variable mechanism portion is constructed of the second rotation member 117, the swing member 110, the thrust bearing 111 and the rotary member 108. Specifically, as shown in FIG. 4, both the ends of the second rotation member 117 are opened. Further, as shown in FIG. 2, the slant center P1 is positioned opposite the pistons 112 with respect to a connection center line L3 passing through connection centers between the rods 113 and the swing member 110. Thus, the swing support mechanism 114 forms an adjustable joint, and supports the swing member 110 in capable of swinging. More specifically, operation states of the swing support mechanism 114 while the swing member 110 swings are shown in FIGS. 6A, 6B, 6C, 7A, 7B, and 7C.

In FIG. 2, refrigerant is supplied to plural operation chambers V through a suction chamber 121. The plural operation chambers V are defined by the cylinder bores 103, the valve plate 104 and the pistons 112. The valve plate 104 has suction ports 123 through which the suction chamber 121 communicates with the plural operation chambers V, and discharge ports 124 through which the operation chambers V communicate with a discharge chamber 122. Suction valves (not shown), for preventing refrigerant from flowing from the operation chamber V to the suction chamber 120, are provided in the suction ports 123, respectively. Discharge valves (not shown), for preventing refrigerant from flowing from the discharge chamber 122 to the operation chamber V, are provided in the discharge ports 124, respectively.

The suction valves and the discharge valves are fixed between the middle housing 102 and the rear housing 105, together with valve stopper plates 125. Each of the valve stopper plates 125 restricts a maximum open degree of the discharge valve. A shaft seal 126 is provided to prevent refrigerant stored in a crank chamber 127, in which the swing member 110 is disposed, from leaking outside the housing from a clearance between the front housing 101 and the shaft 106. A pressure control valve 128 controls refrigerant pressure in the crank chamber 127 by adjusting a communication state between the crank chamber 127 and the suction chamber 121 and a communication state between the crank chamber 127 and the discharge chamber 122.

Next, operation of the compressor 100 according to the first embodiment will be described. FIG. 2 shows the maximum displacement operation (i.e., 100% displacement operation) of the compressor 100. As shown in FIG. 2, when the compressor 100 is operated at the maximum displacement, refrigerant pressure in the crank chamber 127 is made lower than that in the operation chamber V (discharge pressure) by adjusting the pressure control valve 128. Therefore, at this time, force (i.e., compression reactive force) is applied to the pistons 112 in a direction in which the operation chamber V is enlarged. On the other hand, because the swing member 110 is held by the swing support member 114, the compression reactive force is applied to the swing member 110 around the connection pin 109 as a supporting point. That is, a moment (slant moment) is applied to the swing member 110 in a direction in which the slant angle θ is reduced. Therefore, the slant angle θ is reduced, and a stroke of each piston 112 is increased, thereby increasing the displacement of the compressor 100.

Figure 8:
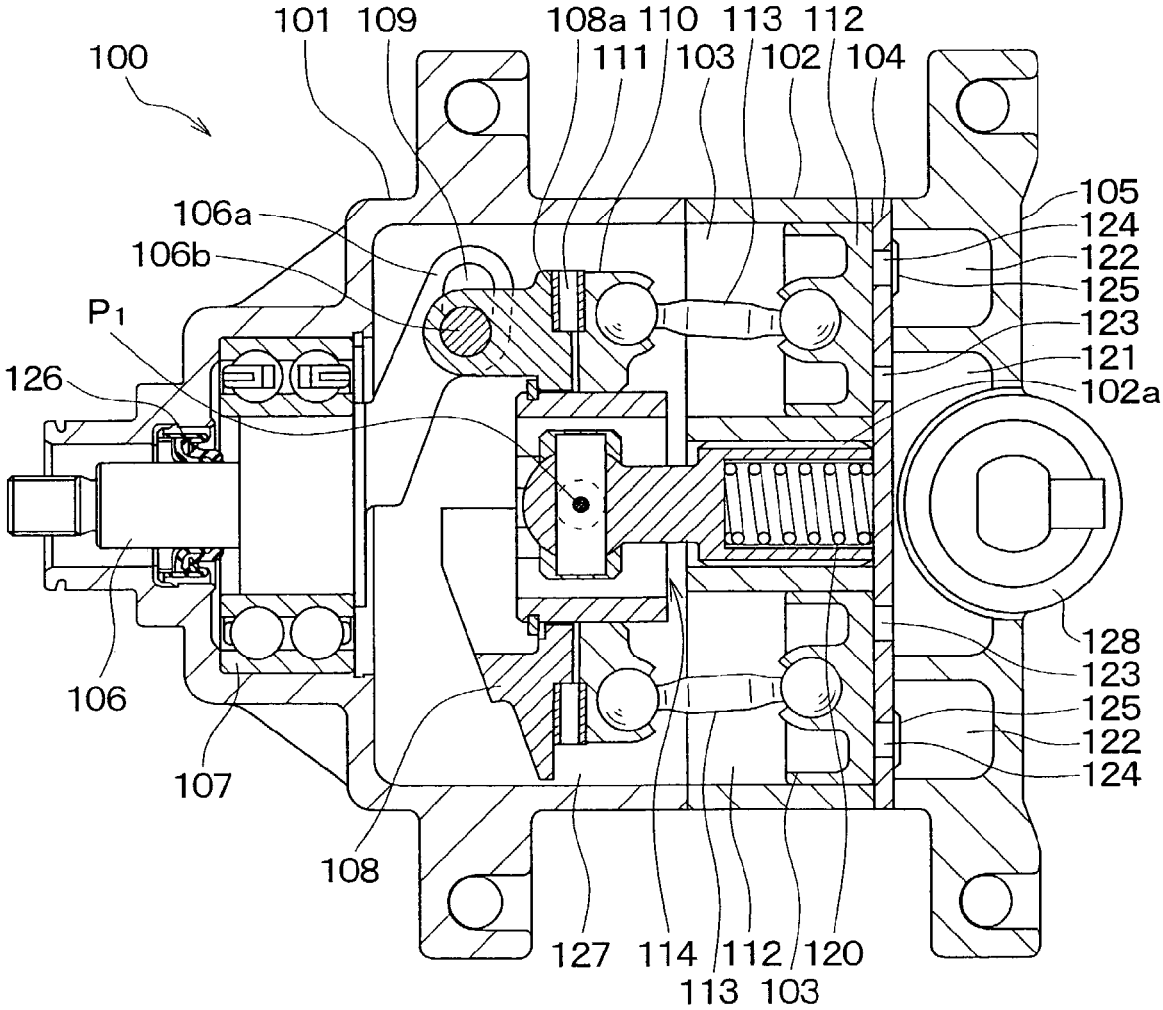
FIG. 8 is a cross-sectional view showing a compressor in minimum-displacement operation (0% displacement operation), according to the first embodiment.

FIG. 8 shows the minimum displacement operation (0% displacement operation) of the compressor. When the compressor 100 is operated at a variable displacement between the maximum displacement operation and the minimum displacement operation, refrigerant pressure in the crank chamber 127 is made larger than that in the maximum displacement operation. Therefore, the compression reactive force (slant moment) becomes smaller than that in the maximum displacement operation, and the slant angle θ is increased, thereby reducing the displacement of the compressor 100 from the maximum displacement.

Next, advantages of the compressor 100 according to the first embodiment will be described. In the first embodiment, the swing member 110 is supported by the swing support member 114 to be swung while being prevented from rotating about the center axis Lo. Therefore, even when the shaft 106 rotates at a high rotational speed, the swing member 110 can be prevented from rotating about the shaft 106. Accordingly, the pistons 112 can be prevented from violently vibrating, thereby restricting large noise from being generated. As a result, reliability (durability) of the compressor 100 can be increased even when the compressor 100 operates at a high rotational speed.

Further, the swing support member 114, for preventing the swing member 110 from rotating while supporting the swing member 110 to be swung, is disposed substantially at a center of the swing member 110. Therefore, an inertia moment of the swing member 110 can be reduced. Further, while the swing member 110 is dynamically balanced, the size of the compressor 100 can be made smaller as compared with a compressor where a rotation lock mechanism, for restricting the swing member 110 from rotating, is provided at an outer periphery of the swing member 110. Thus, in the first embodiment, the swing member 110 can smoothly swing while its size can be effectively reduced.

Further, the slant center P1 around which the swing member 110 swings is made to substantially correspond to the center of gravity of the variable mechanism portion constructed of the second rotation member 117, the swing member 110, the thrust bearing 111 and the rotary member 108. Therefore, the slant moment, for changing the slant angle θ of the swing member 110 (rotary member 108), is not generated in structure. Furthermore, a deviated dimension of the slant center P1 from the center of gravity of the variable mechanism portion is substantially zero. Accordingly, large vibration and large sound noise can be prevented from being generated even when the compressor 100 operates at a high rotational speed. Thus, the durability of the compressor 100 can be further improved, and its sound noise can be effectively reduced.

Further, because both the axial ends of the second rotation member 117 of the swing support member 114 are opened, the slant center P1 can be readily located opposite the pistons 112 with respect to the connection center line L3. Therefore, the slant center P1 can be readily made to correspond to the center of gravity of the variable mechanism portion constructed of the second rotation member 117, the swing member 110, the thrust bearing 111 and the rotary member 108. If the slant center P1 is positioned at the same side of the pistons 112 with respect to the connection center line L3, mass of the swing member 110, the rods 113 and the pistons 112 is required to be sufficiently reduced in order to make the slant center P1 to correspond to the center of gravity of the variable mechanism portion. Therefore, actually, in this case, the slant center P1 is difficult to correspond to the center of gravity of the variable mechanism portion.

Figure 9A:
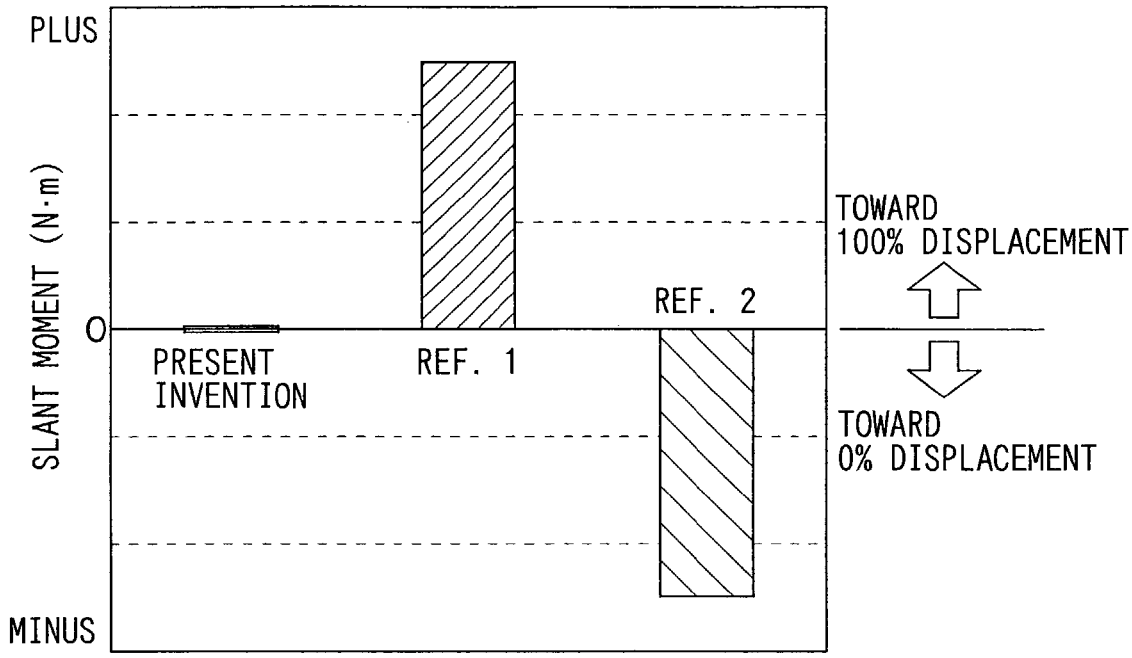
FIG. 9A is a bar graph showing slant moments of compressors in the present invention and reference examples 1 and 2.
Figure 9B:
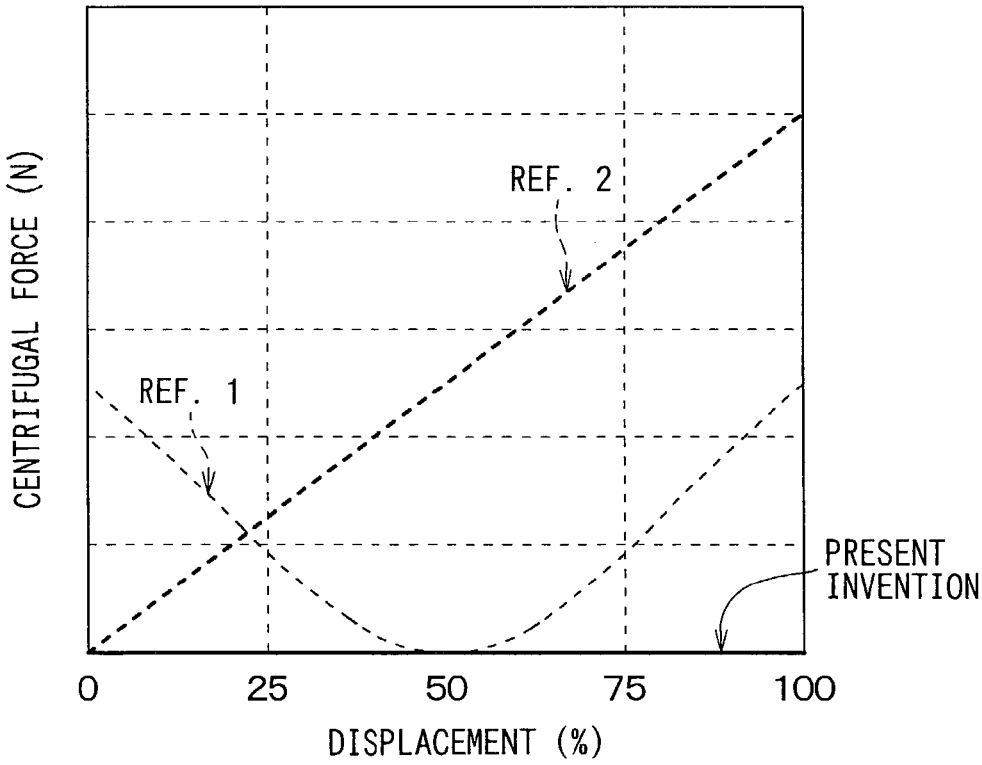
FIG. 9B is a graph showing centrifugal force applied to swing members in the present invention and the reference examples 1 and 2 in FIG. 9A.

As shown in FIG. 9A, in a compressor of a reference 1, the slant moment is structurally large toward the 100% displacement in the plus area. On the other hand, in a compressor of a reference 2, an absolute value of the slant moment is structurally large toward the 0% displacement in the minus area. However, in the compressor 100 of the present invention, the slant moment is substantially not caused in the structure at both the plus side and the minus side. Further, as shown in FIG. 9B, centrifugal force applied to the swing member is larger at the 0% displacement side and the 100% displacement side in the compressor of the reference 1. In the compressor of the reference 2, the centrifugal force is larger at the 100% displacement side. However, in the compressor 100 of the present invention, the centrifugal force is substantially is not applied in the entire displacement area of the compressor 100.

SECOND EMBODIMENT

Figure 10:
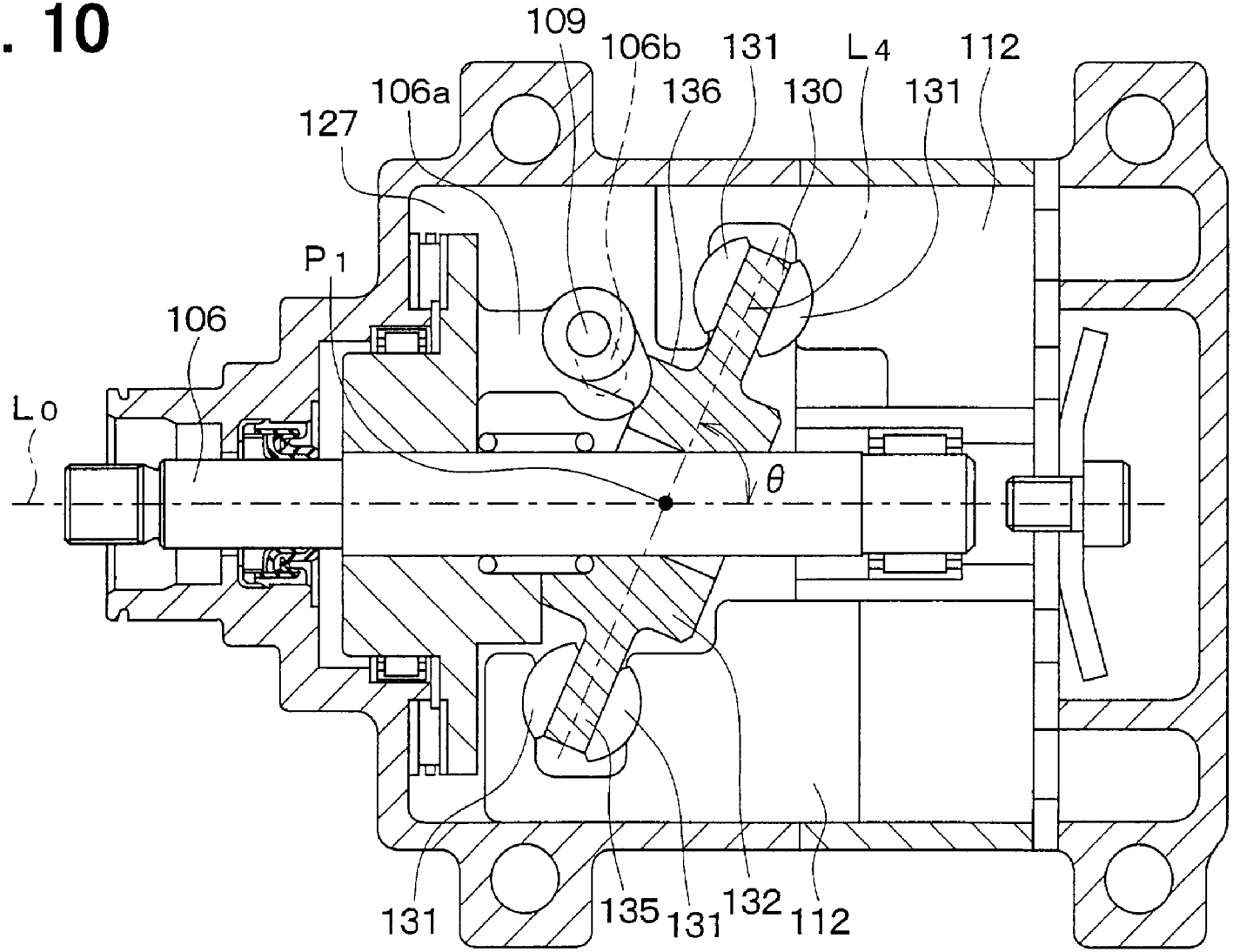
FIG. 10 is a cross-sectional view showing a compressor according to a second embodiment of the present invention.

In the above-described first embodiment, the present invention is typically applied to the wobble-type variable displacement compressor. However, in the second embodiment, as shown in FIG. 10, the present invention is applied to a swash plate compressor. The swash plate compressor includes a swash plate 130, shoes 131, a balancer 132 and the like. The swash plate 130 rotates integrally with the shaft 106 while slanting with respect to the center axis Lo of the shaft 106, thereby reciprocating the pistons 112. Each of the shoes 131 pinches the swash plate 130 at a radially outward location and slidably contacts the swash plate 130. Further, the shoes 131 connect the swash plate 130 and the pistons 112 so that the pistons 112 are reciprocated. The balancer 132 is disposed to compensate for centrifugal force applied to the swash plate 130. In the swash plate compressor, as in the wobble-type variable displacement compressor, refrigerant pressure in a swash chamber 127 whore the swash plate 130 is disposed is adjusted by a pressure control valve (not shown), so that its displacement is changed by controlling the slant angle θ of the swash plate 130.

The slant plate 130 is constructed of a circular plate 135, an arm 136 and the like. The circular plate 135 has a slide surface where the shoes 131 contact. The arm 136 is connected by the connection pin 109 to the arm 106*a* of the shaft 106, so that rotational force of the shaft 106 is transmitted to the circular plate 135. Here, the arm 136 is integrated to the circular plate 135 at a position offset from the center of gravity of the circular plate 135. Therefore, the center of gravity of the swash plate 130 is offset from the center of gravity of the circular plate 135, that is, the center axis Lo of the shaft 106. In the second embodiment, a balancer 132, for compensating a deviation dimension due to the arm 136, is provided opposite the arm 136 with respect to the center of gravity of the circular plate 135, at a position except for a contact portion between the swash plate 130 and the shoes 131. Thus, the slant center P1 of the swash plate 130 and the center of gravity thereof can be made to generally correspond to each other regardless of the slant angle θ.

Further, in the second embodiment, the balancer 132 is molded integrally with the swash plate 130, that is, the circular plate 135. However, the balancer 132 may be formed separately from the circular plate 135 without being limited to this manner. In this case, the separated balancer 132 can be integrated to the circular plate 135 by screwing or welding.

THIRD EMBODIMENT

Figure 11:
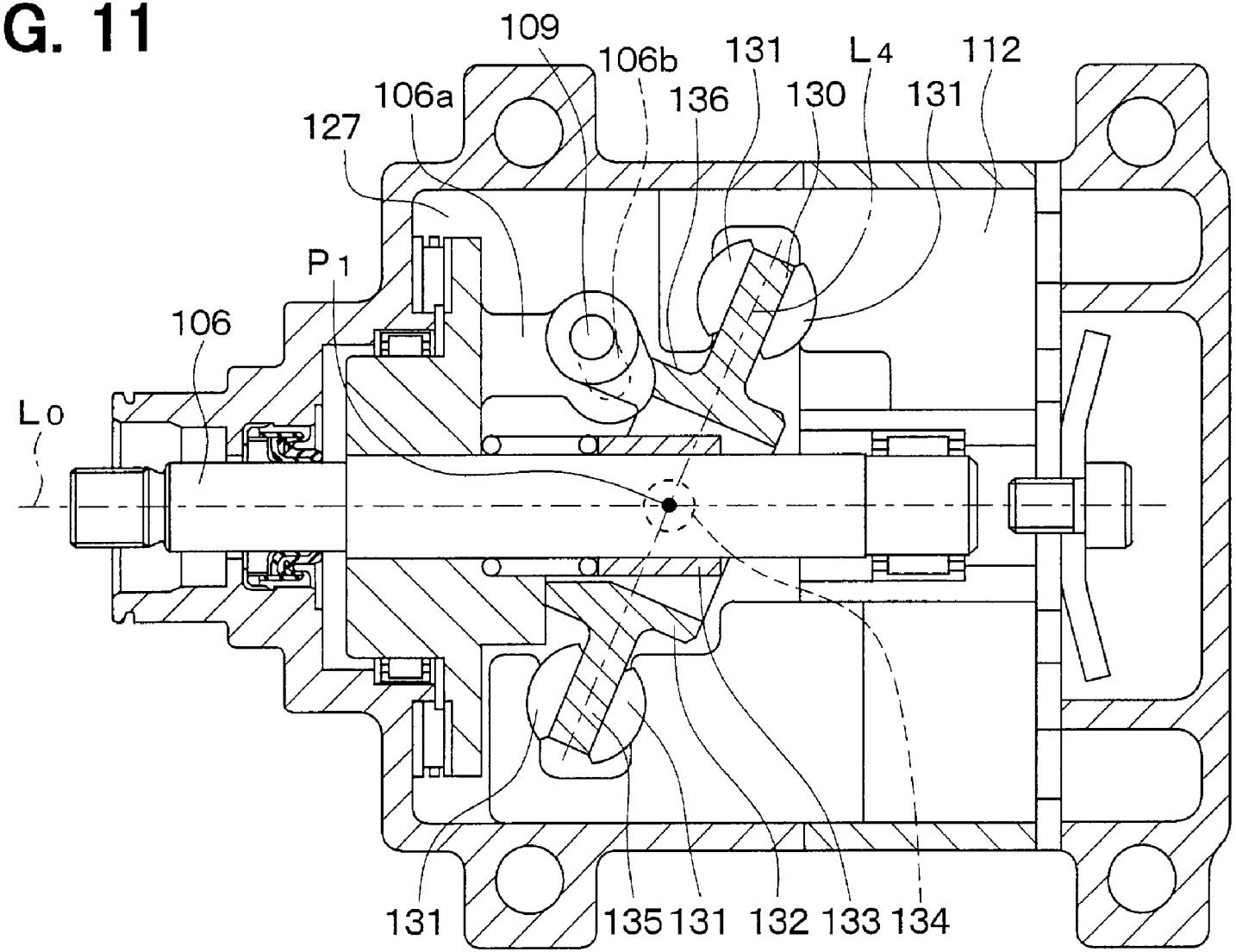
FIG. 11 is a cross-sectional view showing a compressor according to a third embodiment of the present invention.
Figure 12B:
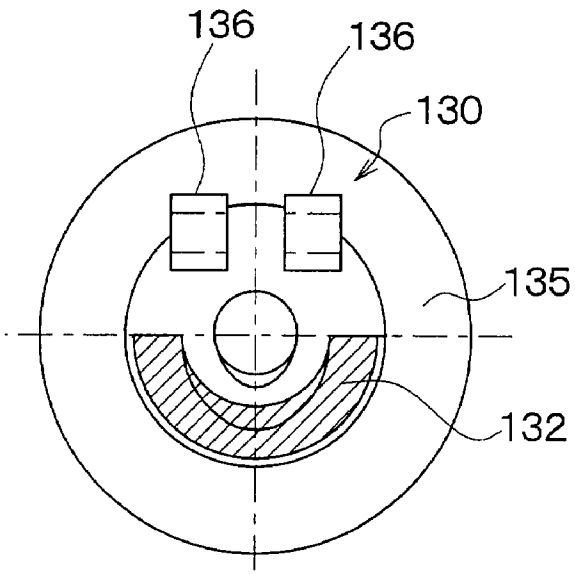
FIG. 12B is a schematic diagram for explaining the compressor in FIG. 12A.
Figure 12A:
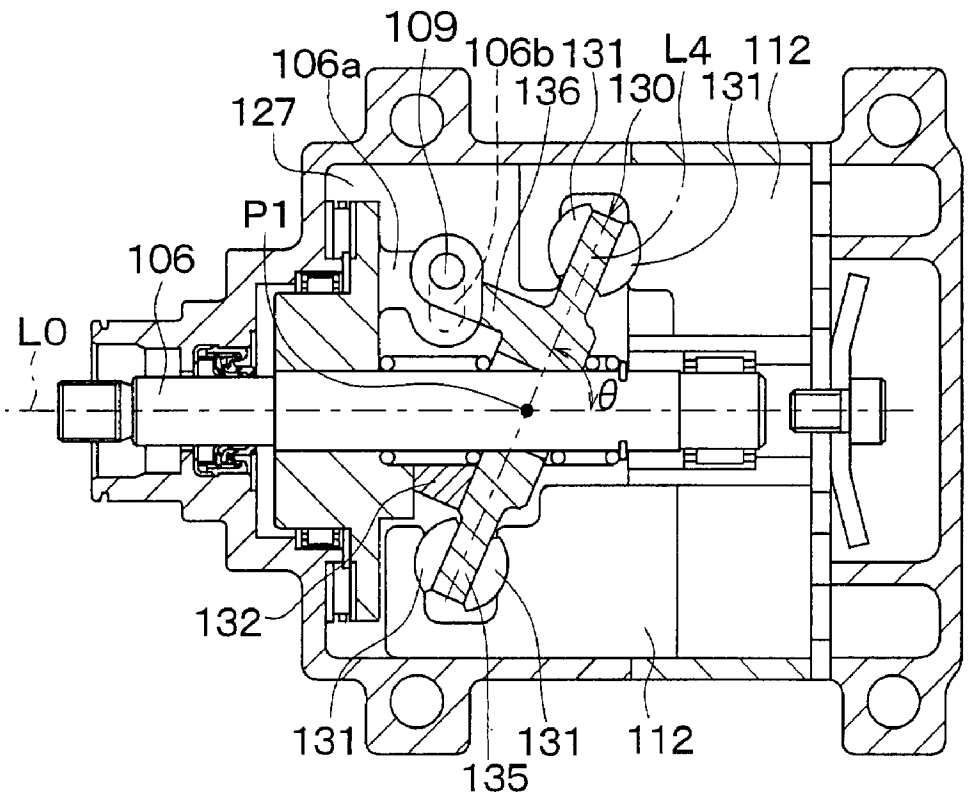
FIG. 12A is a cross-sectional view showing a compressor according to a fourth embodiment of the present invention.
Figure 13B:
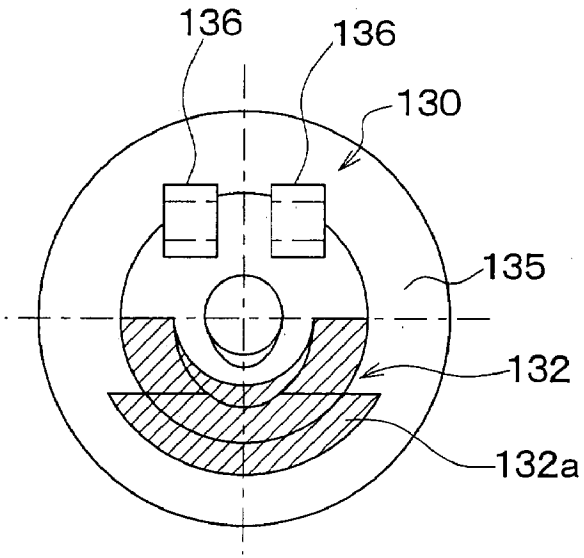
FIG. 13B is a schematic diagram for explaining the compressor in FIG. 13A.
Figure 13A:
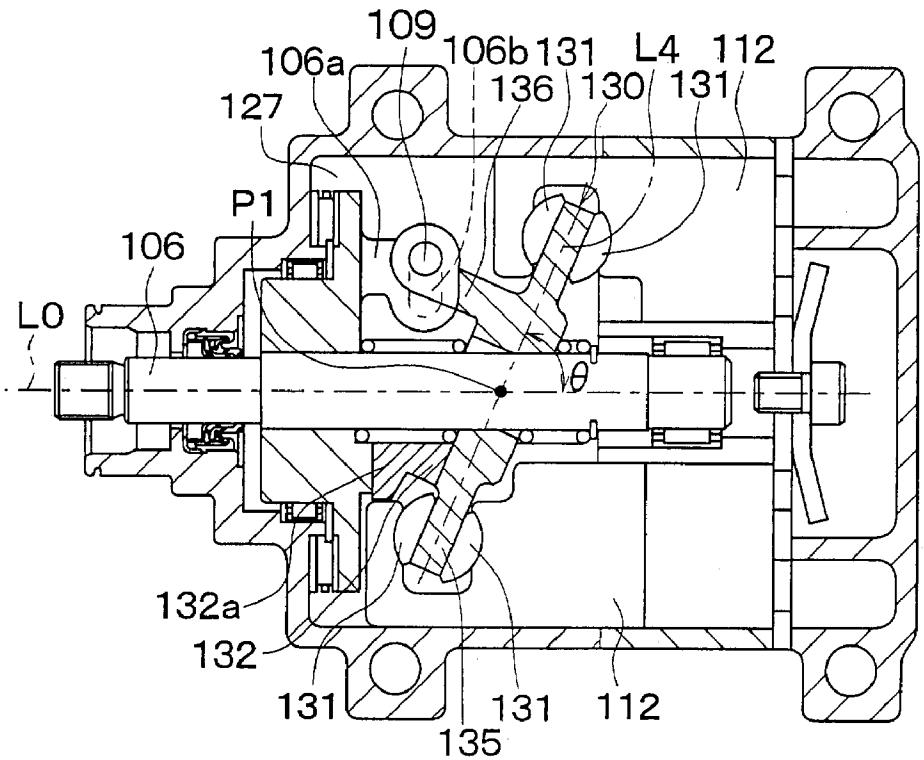
FIG. 13A is a cross-sectional view showing a compressor in an other example of the fourth embodiment.

The third embodiment is a modification of the above-described second embodiment. As shown in FIG. 11, in the third embodiment, a cylindrical collar 133 is attached to the shaft 106 to be slidable on the shaft 106, and a support pin 134 is provided on an outer peripheral surface of the cylindrical collar 133. The swash plate 130 is disposed to swing about the support pin 134, and is slanted relative to the center axis Lo of the shaft 106. Accordingly, in the third embodiment, a center of the support pin 134 is the slant center P1. In the third embodiment, the other parts are similar to those of the above-described second embodiment, and the advantages described in the second embodiment can be obtained.

FOURTH EMBODIMENT

The fourth embodiment is a modification of the above-described second embodiment. In the fourth embodiment, as shown in FIGS. 12A,-12B, 13A, 13B, a balancer 132 is provided on the circular plate 135, opposite the arm 136 with respect to the center of gravity of the circular plate 135, and at the same side of the arm 136 with respect to the center line (that is, the reference line L4) of the circular plate 135. Further, in the example shown in FIGS. 13A, 13B, a flange 132*a* is added to the balancer 132, and increases an inertia moment to the center of gravity of the circular plate 135.

In the fourth embodiment, the other parts are similar to those of the above-described second embodiment, and the advantages described in the second embodiment can be obtained.

FIFTH EMBODIMENT

Figure 14B:
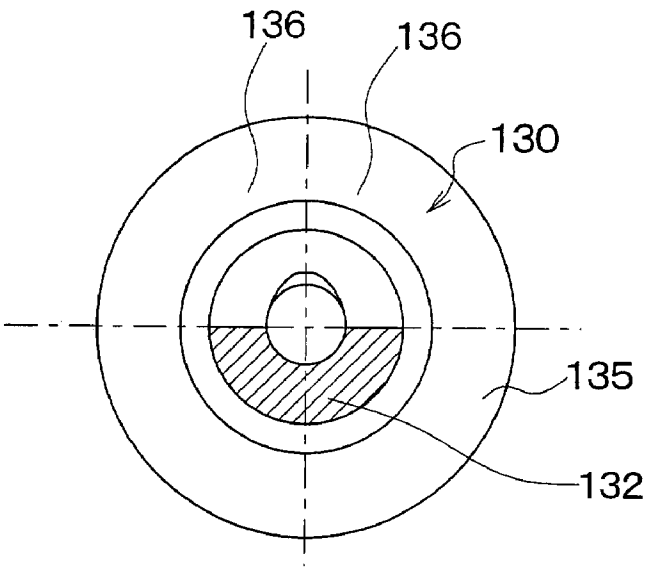
FIG. 14B is a schematic diagram for explaining the compressor in FIG. 14A.
Figure 14A:
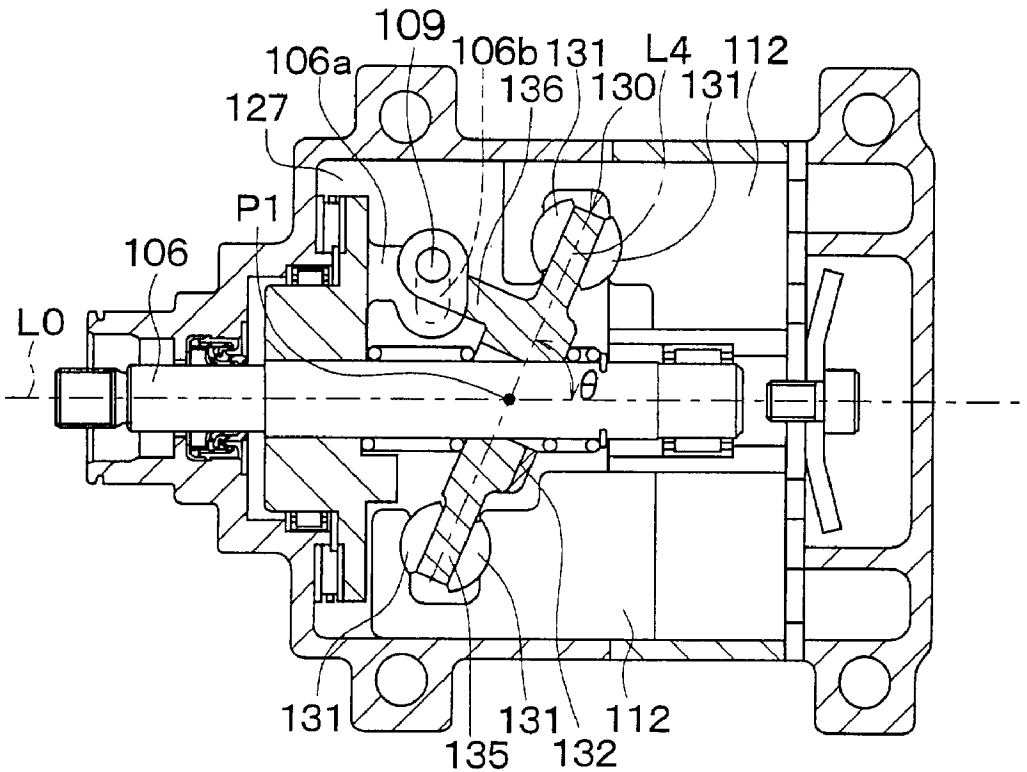
FIG. 14A is a cross-sectional view showing a compressor according to a fifth embodiment of the present invention.

The fifth embodiment is a modification of the above-described second embodiment. In the fifth embodiment, as shown in FIGS. 14A, 14B, the balancer 132 is provided on the circular plate 135, opposite the arm 136 with respect to the center of gravity of the circular plate 135, and opposite the arm 136 with respect to the reference line L4. In the fifth embodiment, the other parts are similar to those of the above-described second embodiment.

SIXTH EMBODIMENT

Figure 15B:
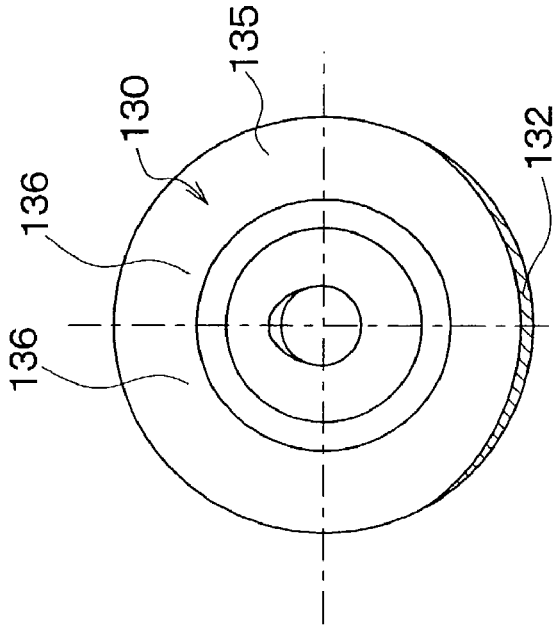
FIG. 15B is a schematic diagram for explaining the compressor in FIG. 15A.
Figure 15A:
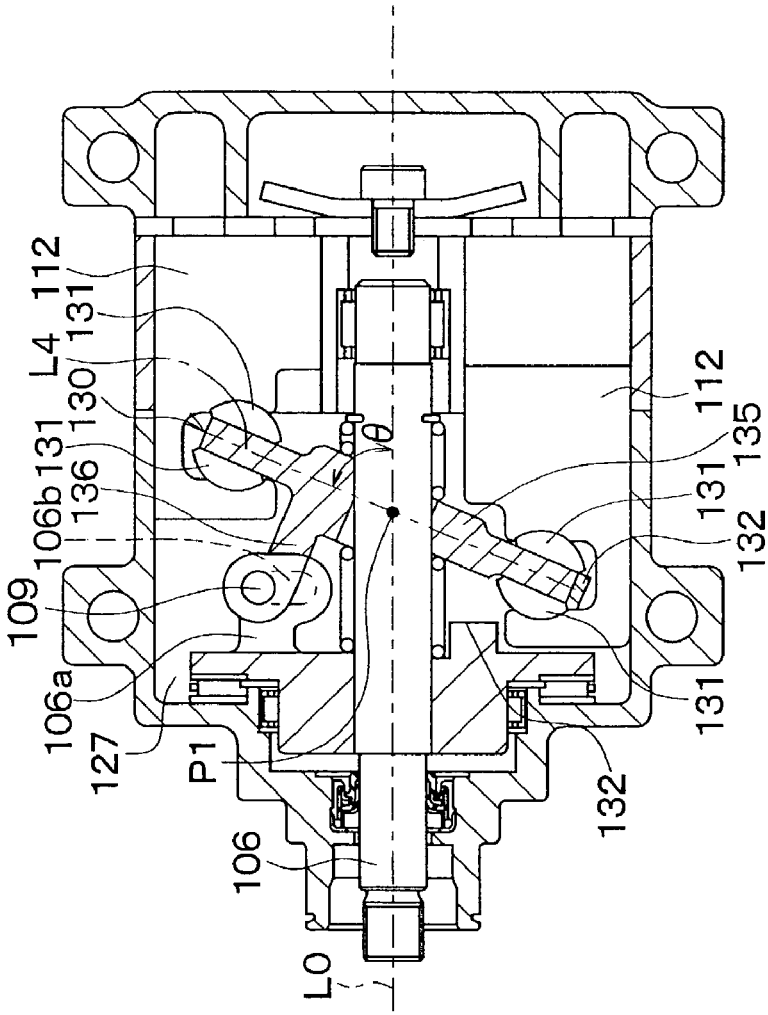
FIG. 15A is a cross-sectional view showing a compressor according to a sixth embodiment of the present invention.
Figure 16B:
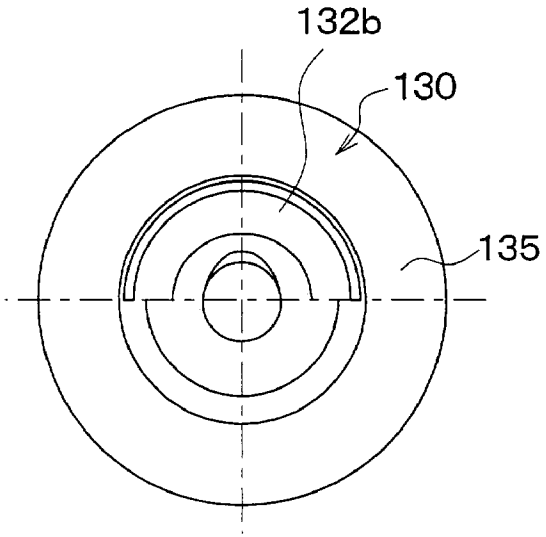
FIG. 16B is a schematic diagram for explaining the compressor in FIG. 16A.
Figure 16A:
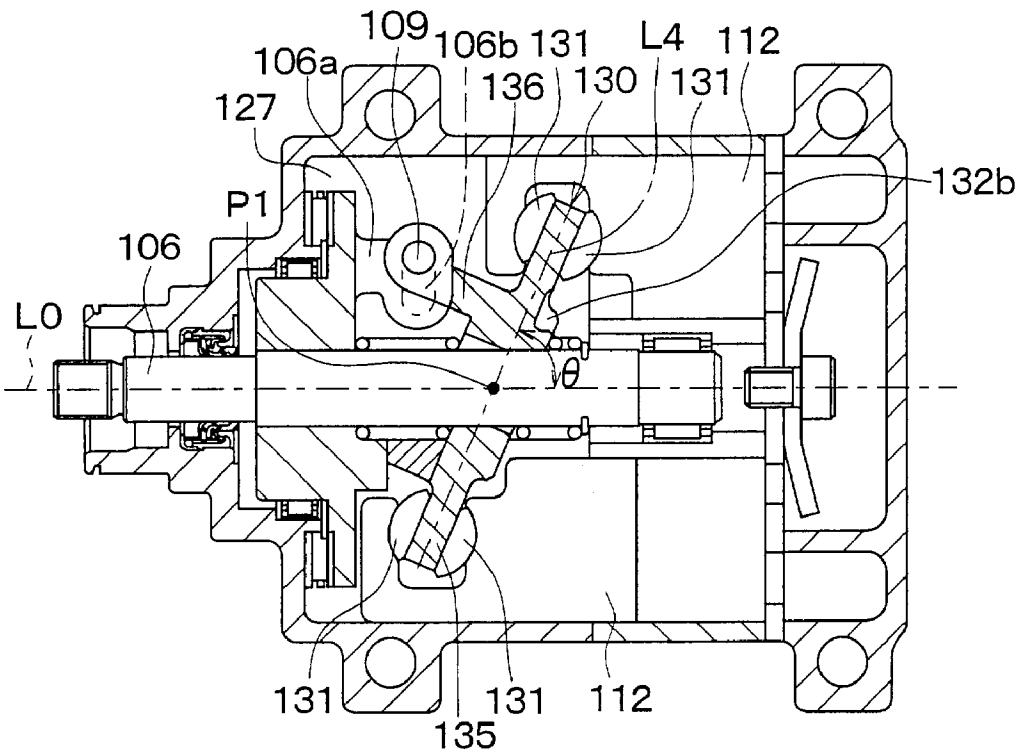
FIG. 16A is a cross-sectional view showing a compressor according to a seventh embodiment of the present invention.
Figure 17B:
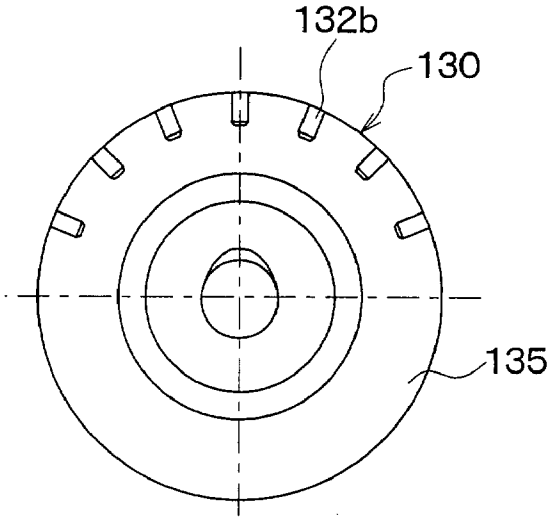
FIG. 17B is a schematic diagram for explaining the compressor in FIG. 17A.
Figure 17A:
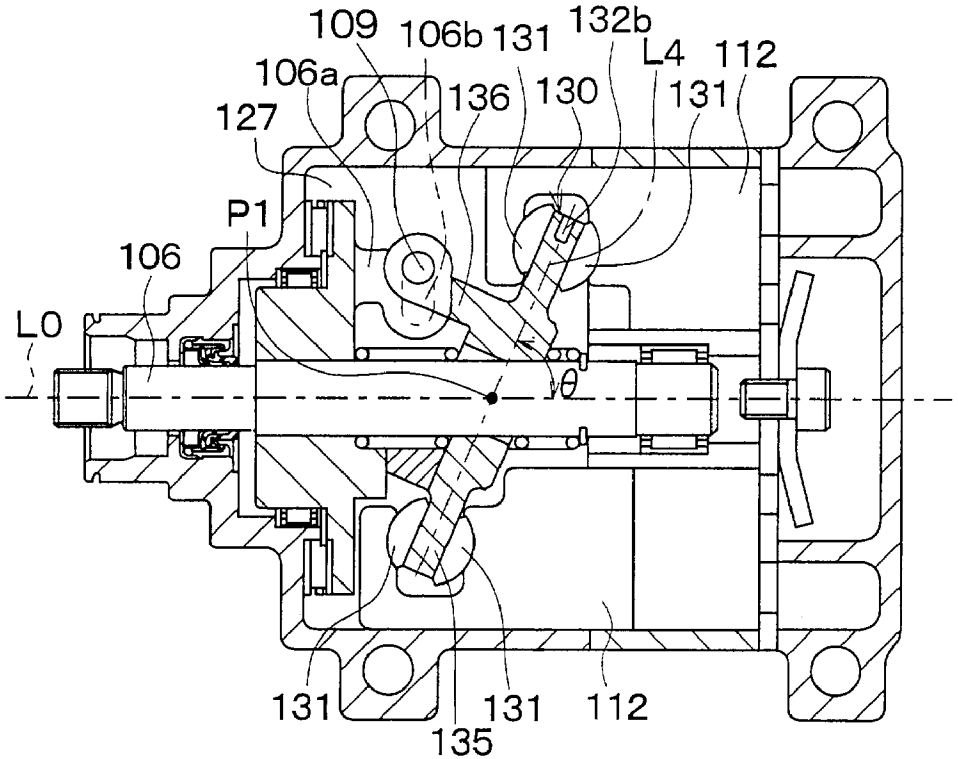
FIG. 17A is a cross-sectional view showing a compressor according to a modification of the seventh embodiment.

The sixth embodiment is a modification of the above-described second embodiment. In the sixth embodiment, as shown in FIGS. 15A, 15B, the balancer 132 is provided on the circular plate 135, opposite the arm 136 with respect to the center of gravity of the circular plate 135, at an outer periphery of the circular plate 135. Accordingly, a large inertia moment can be obtained without increasing mass of the balancer 132, thereby readily balancing the swash plate 130 while restricting driving force of the shaft 106 from increasing.

SEVENTH EMBODIMENT

In the seventh embodiment, as shown in FIGS. 16A, 16B, 17A, 17B, a hole 132*b* or a slit is provided in the circular plate 135 at the same side as the arm 136 with respect to the slant center P1. Thus, an inertia moment of the circular plate 135 is reduced on the same side as the arm 136 than a side opposite the arm 136, with respect to the slant center P1, thereby compensating an inertia moment of the arm 136, and balancing the swash plate 130. Accordingly, mass and the inertia moment of the swash plate 130 are reduced, thereby restricting driving force of the shaft 106 from increasing, and balancing the swash plate 130. For example, in FIGS. 16A, 16B, the hole 132*b* is provided in the circular plate 135 in a radial inside area. On the other hand, in FIGS. 17A, 17B, slits 132*b* are provided in the circular plate 135 in a radial outside area.

Although the present invention has been fully described in connection with the preferred embodiments thereof with reference to the accompanying drawings, it is to be noted that various changes and modifications will become apparent to those skilled in the art.

For example, in the above-described first embodiment, the swing support mechanism 114 is constructed with the adjustable joint having a hook joint shape. However, in the present invention, a joint having rollers such as a uniform-motion ball joint may be used as the swing support mechanism 114 without being limited to this manner.

In the above embodiments, the fluid apparatus of the present invention is applied to the compressor for the vapor compression refrigerant cycle. However, the present invention can be applied to a fluid pump, a compressor and the like in another use without being limited to this manner.

Such changes and modifications are to be understood as being within the scope of the present invention as defined by the appended claims.

What is claimed is:

1. A fluid apparatus comprising:

a shaft disposed to be rotatable;

a plurality of pistons disposed to be reciprocated;

a housing for containing the shaft, the housing having a plurality of cylinder bores in which the pistons are disposed;

a swash plate rotatable integrally with the shaft for reciprocating the pistons, the swash plate slanting with respect to a center axis of the shaft, wherein the swash plate has a slant center about which the swash plate pivots while slanting, and the slant center substantially corresponds to the center of gravity of the swash plate;

a balancer that adjusts the slant center of the swash plate to a position substantially corresponding to the center of gravity of the swash plate, regardless of a slant angle of the swash plate with respect to the center axis of the shaft;

a shoe disposed at a radial outside portion of the swash plate to pinch the swash plate while slidably contacting the swash plate, wherein:

the center of gravity of the swash plate is substantially on the center axis of the shaft;

the swash plate and the pistons are connected through the shoe to be reciprocated; and the swash plate includes a circular plate having a slide surface that contacts and slides against the shoe, wherein the circular plate has a first side that faces generally toward the pistons and a second side at faces generally away from the pistons, the first side being opposite to the second side, and an arm for transmitting rotation of the shaft to the circular plate, the arm being integrated with the circular plate at a position offset from a center gravity of the circular plate; and the balancer is provided in the circular plate at a position other than the slide surface; and the balancer is provided in the first side of the circular plate and the arm is provided in the second side of the circular plate such that the arm and the balancer are located on opposite sides of the circular plate.

2. The fluid apparatus according to claim 1, wherein the balancer is provided on the circular plate at an outer periphery.

3. The fluid apparatus according to claim 1, wherein the balancer is formed separately from the circular plate and is attached to the circular plate.

4. A fluid apparatus comprising:

a rotatable shaft, wherein the rotatable shaft defines a center axis;

a plurality of pistons;

a housing for supporting the shaft, wherein the housing includes a plurality of cylinder bores in which the pistons are respectively fitted;

a swash plate that rotates integrally with the shaft for reciprocating the pistons, wherein the swash plate inclines with respect to a center axis of the shaft about a pivot center, and the pivot center substantially corresponds to the center of gravity of the swash plate, and wherein the center of gravity of the swash plate substantially coincides with the canter axis, and the swash plate includes:

a first end that faces generally toward the pistons and a second end that faces generally away from the pistons, the first end being opposite to the second end;

an arm for transmitting rotation of the shaft to the swash plate, the arm being located at a position offset from the center of gravity of the swash plate;

a balancer that adjusts the pivot center of the swash plate to a position substantially corresponding to the center of gravity of the swash plate, regardless of the inclination of the swash plate with respect to the center axis of the shaft, and wherein the balancer is provided on the first end of the swash plate and the arm is provided on the second end of the swash plate such that the arm and the balancer are located on opposite ends of the swash plate, and the balancer is further located on a part of the swash plate that is generally opposite to the arm with respect to the center axis, such that the arm and the balancer are located on opposite sides of the center axis; and a radially outer slide surface, wherein the balancer is provided at a location of the swash plate other than the slide surface; and a plurality of shoes that engage the slide surface of the swash plate for transmitting motion between the pistons and the swash plate.

* * * * *